United States Patent [19]

Frazier

[11] 4,257,883

[45] Mar. 24, 1981

[54] PARTS SORTING MECHANISM

[75] Inventor: Steven P. Frazier, Tarsney Lakes, Mo.

[73] Assignee: Realex Corporation, Kansas City, Mich.

[21] Appl. No.: 11,323

[22] Filed: Feb. 12, 1979

[51] Int. Cl.[3] ..... B07B 13/05

[52] U.S. Cl. ..... 209/664; 209/674

[58] Field of Search ..... 209/660, 664, 674, 675–679, 209/683, 682, 689; 133/3 R, 3 A–3 E

[56] References Cited

U.S. PATENT DOCUMENTS

| | | | |
|---|---|---|---|
| 1,188,494 | 6/1916 | Savrda | 133/3 C |
| 1,813,841 | 7/1931 | Fast | 133/3 R |

*Primary Examiner*—Allen N. Knowles

*Attorney, Agent, or Firm*—Schmidt, Johnson, Hovey & Williams

[57] ABSTRACT

As parts of two different sizes are dropped into the mechanism, they are received by a rotor that rotates about an upright axis and is provided with a generally conical configuration such that the parts slide along the conical rotor in a radially outward and downward direction. The conical upper surface of the rotor is formed in part by fin-like members having uppermost longitudinal edges that define the sliding conical surface for the parts, the lateral spacing between such fins being such as to permit the smaller parts to drop between the fins and onto a lower conical surface, also sloping radially outwardly and downwardly from the axis of the rotor, while the larger parts remain supported by the fins. The parts thus sorted into a pair of vertically separated levels are driven by the rotor along a circular wall at the periphery of the rotor until reaching respective vertically offset outlets arranged to receive their respective larger or smaller parts by gravity feed from the corresponding portions of the rotor.

10 Claims, 7 Drawing Figures

PARTS SORTING MECHANISM

TECHNICAL FIELD

This invention relates to mechanism for classifying or sorting products of two different sizes from one another and has particular, but not exclusive, utility in connection with the plastics molding industry in which it is necessary to sort relatively small molded components from their larger plastic "runners" as the runners and components are ejected from a molding machine.

BACKGROUND ART

In the production of plastic components by an injection molding process, the mold cavities corresponding to the components are interconnected by a network of supply channels through which the molten plastic material is delivered to the various cavities during each injection cycle of the molding machine. Such channels necessarily result in the formation of plastic "runners" much like the branches of a tree to which the components are attached as the molten plastic is cured. Although most modern machines automatically detach the components from the runners as the mold halves separate upon completion of the cycle, it is still necessary to sort out the runners from the components such that the runners can be reprocessed if desired and the components can be assembled with other parts or otherwise handled.

Typically, these parts have been sorted by hand, but this can be a tedious, routine and unduly costly procedure. Some machinery is presently available to replace hand sorting, but such machinery is less than entirely reliable and is quite bulky, occupying considerably more than the desired amount of space which could otherwise be directed to better purposes.

For example, one type of known machine utilizes a linear conveyor belt on which the mixture of components and runners drops by gravity. The belt moves the mixture toward a dumping point, and at that location, as the end of the belt is reached, the smaller components drop off the belt while the larger, tree-like runners are caught in the fingers of a closely positioned upwardly moving belt at the point of drop off, thereby lifting the runners off the end of the main belt and conveying them to a separate location.

SUMMARY OF THE PRESENT INVENTION

An important object of the present invention is to provide a highly reliable yet compact parts sorter having particular utility in the separation of plastic runners from their associated component parts, and to this end the present invention includes a bowl into which the mixture of parts is dumped by the molding machine. Within such bowl, a special rotor revolves relatively slowly about an upright axis, and the rotor is provided with a series of fin-like members standing on edge with their upper longitudinal extremities defining elements of a cone having its apex on the axis of rotation of the rotor. The upper extremities of the fins thus define an upper sloping surface that receives the mixture of parts when the same is dumped into the bowl, and because the fins are spaced apart by a strategic amount, only the smaller parts can drop between the fins while the larger runners are held up on top of the fins. The smaller parts are received by a similarly conical though imperforate lower surface as they drop between the fins such that both of the parts, although vertically separated from one another by the fins, are urged by gravity to the outer periphery of the rotor. Thereupon, the fins sweep or drive the separated components around the bowl toward respective, vertically offset outlets through which the parts are separately discharged.

DETAILED DESCRIPTION

Figure 1:
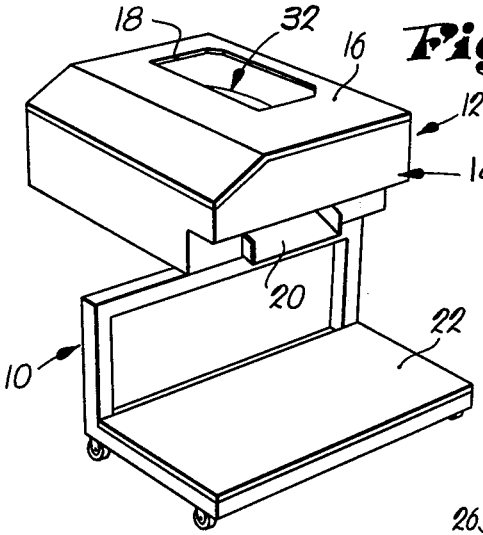
FIG. 1 is a left, front perspective view of parts sorting mechanism constructed in accordance with the present invention and adapted for easy portability.

The mechanism according to the present invention is shown for purposes of illustration embodied in a portable unit as in FIG. 1 although it is of course to be understood that the mechanism could indeed be embodied and arranged in many different environments without departing from the principles of the present invention. With this in mind, then, the unit in FIG. 1 is depicted as including a wheeled stand 10 supporting the mechanism 12 for disposition at a location to receive a mixture of runners and components from a molding machine (not shown). The mechanism 12 includes a box-like housing 14 provided with a lid 16 that has an inlet opening 18 through which the runners and components may drop into the mechanism 12 as they are discharged by the machine. A chute 20 projects downwardly and outwardly from the housing 14 adjacent the bottom of the latter for discharging the separated components into an awaiting receptacle (not shown) that may be supported by a platform 22 associated with the stand 10.

The mechanism 12 further includes structure in the nature of a bowl 24 within the housing 14, such bowl 24 having an annular generally upright side wall 25, an annular, downwardly and inwardly sloping side wall 26 as an extension of said upright side wall 25, and an annular, upturned and inwardly extending lip 28 as an extension of the side wall 26 at the lower extremity of the latter, said annular lip 25 defining an open bottom 30 of the bowl 24.

Figure 3:
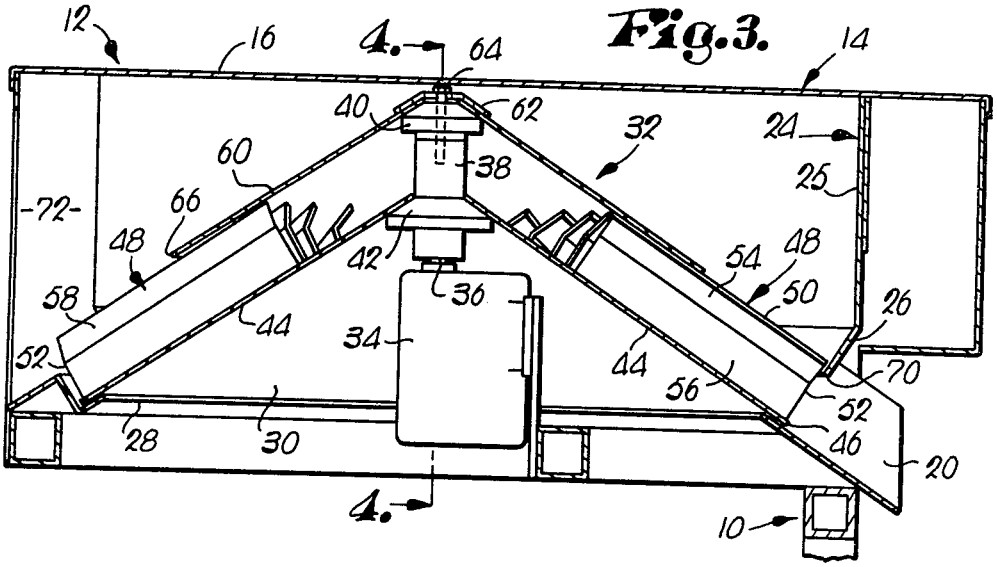
FIG. 3 is a vertical cross-sectional view through the mechanism taken substantially along line 3—3 of FIG. 2.

The mechanism 12 further includes a rotor situated within the bowl 24 and broadly designated by the numeral 32. Said rotor 32 is arranged for rotation about an upright axis coinciding with the upright axis of the bowl 24, and as illustrated in FIG. 3, motive force for driving the rotor 32 may be supplied by an electric motor 34 situated within the open bottom 30 of the bowl 24 and having an upwardly projecting output shaft 36 whose longitudinal axis defines the axis of rotation of the rotor 32. The shaft 36 carries a specially formed hub 38 fixed thereto for rotation therewith, said hub 38 including a pair of vertically spaced apart, truncated cones 40 and 42 respectively.

The rotor 32 further includes what may be referred to as a lower surface 44 that is conical in shape and is attached to the lower cone 42 for support thereby. The lower surface 44 thus slopes radially downwardly and outwardly from the axis of rotation of the rotor 32, and the outermost peripheral termination 46 of the lower surface 44 overlaps the upturned lip 28 such that termination 46 is in closely proximal relationship to the side wall 26.

The rotor 32 further includes a series of fin-like members 48 (hereinafter "fins") which are attached on edge to the lower surface 44 and rise upwardly and outwardly therefrom. The fins 48 are so oriented that their longitudinal uppermost extremities 50 substantially define elements of a cone having its apex on the axis of rotation of the rotor 32. Thus, the upper edge extremities 50 of the fins 48 diverge in a downward and outward direction as their outermost ends 52 are approached, said ends 52 being located substantially at the termination of the lower surface 44 such that ends 52 are likewise in close proximity to the side wall 26 of the bowl 24. As illustrated, each of the fins 48 is of generally planar configuration, yet each is also formed to present a pair of angularly intersecting legs 54 and 56 when viewed in end elevation as in FIG. 5. The leg 56 rises from the surface 44 in perpendicular relationship thereto, while the leg 54 is disposed at a less than 90° angle with respect to the surface 44, presenting a cam surface 58, the function of which will be hereinafter more fully described.

The upper extremities 50 of the fins 48 function as an upper, part engaging surface when the parts to be sorted are dumped into the bowl 24 through the inlet opening 18. On the other hand, because the fins 48 are indeed laterally spaced apart, such spacing has the effect of rendering the upper surface presented by the extremities 50 perforated in nature as opposed to the imperforate nature of the lower surface 44. Like the lower surface 44, however, the upper surface defined by the extremities 50 slopes radially downwardly and outwardly in parallel relationship to the lower surface 44.

Further defining a portion of the upper surface of the rotor 32 is a conical, imperforate crown 60 partially overlying the fins 48 and having an apex on the axis of rotation of the rotor 32. The crown 60 is attached to the upper mounting cone 40 via a hold-down cap 62 and threaded fastener 64 such that the crown 60 rotates with the fins 48 and the lower surface 44 when the rotor 32 is driven by motor 34. The lowermost and outermost peripheral margin 66 of the crown 60 terminates in radially inwardly spaced relationship to the outer ends 52 of the fins 48 such as to expose the latter and define what may be termed a ring-shaped slot 68 between the margin 66 and the side wall 26. The width of said slot 68, of course, depends upon the location of the margin 66 with respect to the side walls 26, and this dimension is subject to some modification depending upon the particular nature of the articles or parts being sorted by the mechanism 12.

The side wall 26 and the lip 24 are cut out for one circumferential portion thereof so as to define an outlet 70 for the smaller parts being sorted. As illustrated perhaps best in FIG. 3, the outlet 70 is disposed at such a vertical location as to be in position for gravitational feeding of the smaller parts from the lower surface 44 while, on the other hand, the upper surface defined by the upper extremities 50 of the fins 48 is located too high to be in registration with the outlet 70, said upper surface instead being in registration with that portion of the side wall 26 located above the outlet 70. The outlet 70 is in direct communication with the discharge chute 20.

Diametrically opposed to the outlet 70 for the smaller parts is an outlet 72 for the larger parts being sorted, said larger parts outlet 72 being formed not only by cut outs in the said walls 26 and 25, but also by a larger cut out in the side of the housing 14. The outlet 72, unlike the outlet 70, is in registration with the upper surface of the rotor 32 as defined by the uppermost extremities 50 of the fins 48 such that the outlet 72 can be described as being vertically offset from the outlet 70. This is true notwithstanding the fact that the outlet 72 includes a lower portion thereof which is disposed almost at the same vertical level as the lower surface 44 at its outermost termination 46, such relationship having no effect on the parts sorting ability of the rotor 32 as will be apparent.

Figure 7:
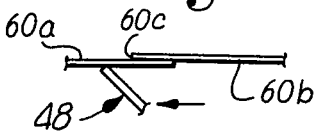
FIG. 7 is a fragmentary, enlarged detail view taken transversely of the conical crown of the rotor and illustrating the way in which such crown may be constructed with overlapping, adjacent segments such as to augment the ability of the crown to drive the runners around the bowl of the mechanism.
Figure 2:
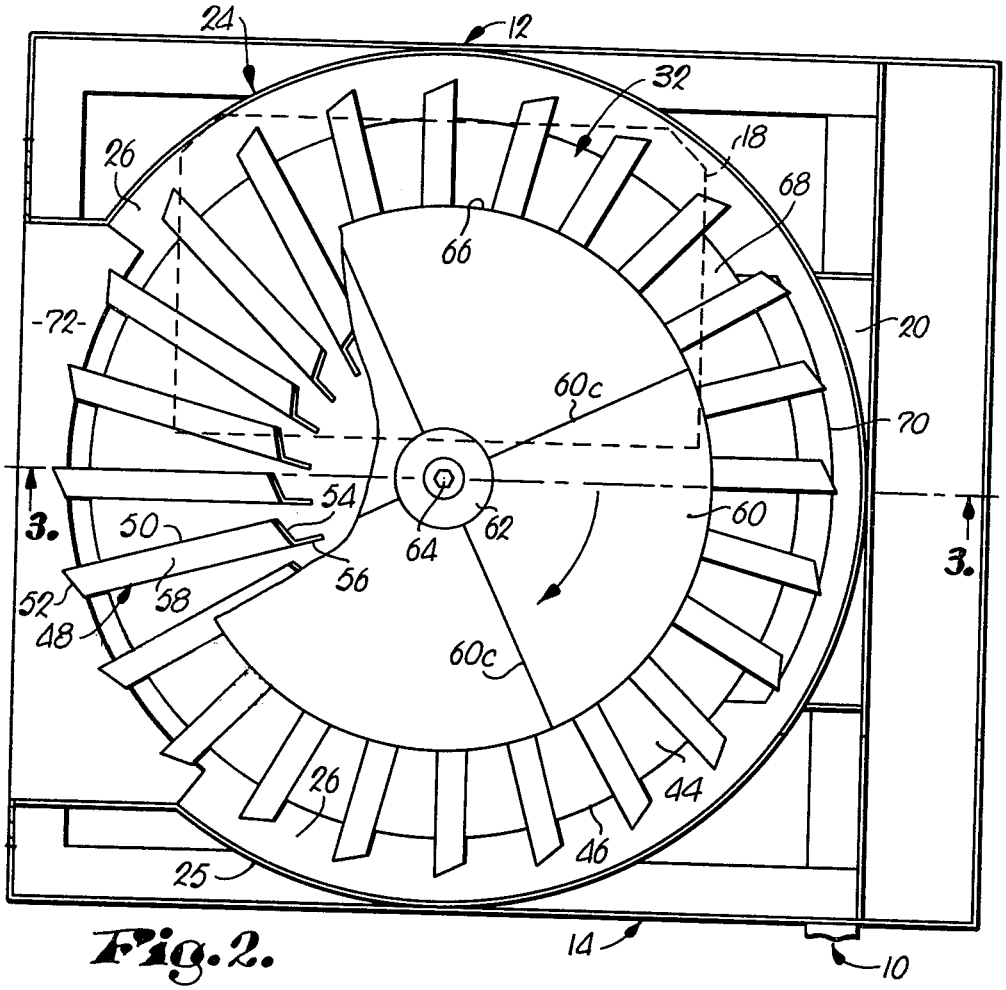
FIG. 2 is a top plan view of the mechanism with the cover removed and parts broken away to reveal details of construction.

As illustrated in FIG. 7, and as also shown in FIG. 2, the crown 60, rather than being one continuous sheet of material, may be formed from a series of mutually overlapping segments as represented by the segments **60*a* and 60*b* in FIG. 7. The overlap presents an outwardly projecting structure 60*c* in the nature of a rib or the like that helps the rotor 32 drive the mixture of parts, particularly the larger of the two parts, around the axis of the rotor 32 during operation, it being understood that the structure 60*c* is of course in a leading relationship with respect to the direction of rotation of the rotor 32**.

OPERATION

Figure 4:
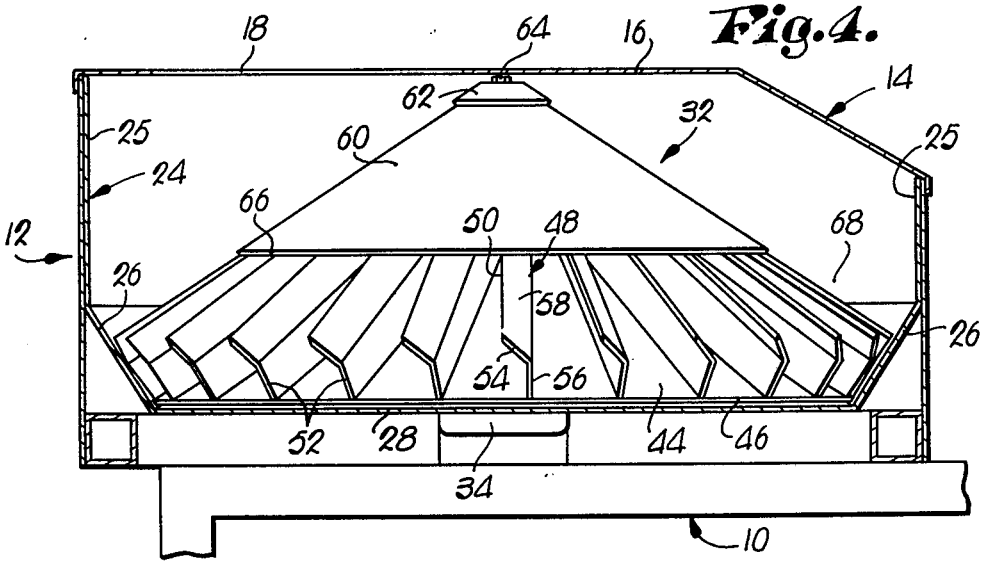
FIG. 4 is a vertical cross-sectional view through the mechanism taken substantially along line 4—4 of FIG. 3.

Taking parts issuing from an injection molding machines as an example of those needing to be separated and sorted, such parts drop into the bowl 24 through the inlet opening 18 positioned with respect to the rotor 32 as illustrated in phantom lines in FIG. 2 and is also illustrated in FIG. 4. The direction of rotation of the rotor 32 is clockwise viewing FIG. 2, and as the mixture of parts falls onto the conical rotor 32, the mixture immediately slides in a radial outward and downward direction along the upper surface defined by the crown 60 and the upper edge extremities 50 of the fins 48. As the smaller parts, such as the components 74 illustrated in FIGS. 5 and 6, reach the ring-shaped slop 68 between the lower margin 66 of crown 60 and the side wall 26, such components 74 drop by gravity between the fins 48 onto the lower surface 44. Surface 44 in turn urges the components 74 in a downward and outward direction to the side wall 26 which prevents further radial movement thereof. At this juncture, the components 74 are swept around the side wall 26 until the outlet 70 is reached, whereupon they simply slide off the surface 44 by gravity into the chute 20 for discharge into an awaiting receptacle which, as earlier described, may advantageously be supported on the platform 22 of the stand 10.

Figure 6:
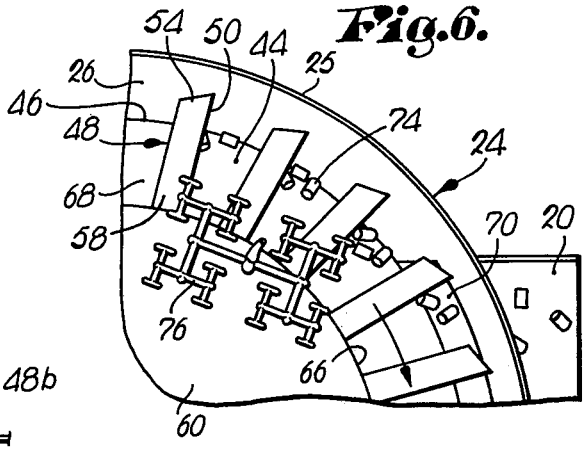
FIG. 6 is a fragmentary top plan view of the mechanism illustrating the sorting process.
Figure 5:
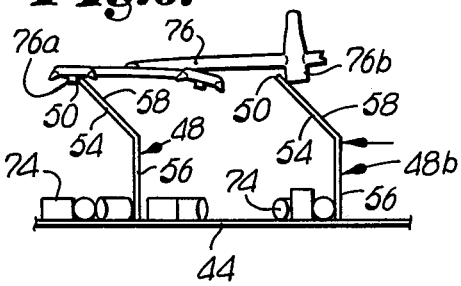
FIG. 5 is an enlarged, fragmentary detail view taken transversely of a pair of adjacent fins of the rotor and illustrating the way in which the runners hang up on the top surface of the fins while the smaller parts drop to the lower surface therebelow.

The runners 76, on the other hand, as illustrated in FIGS. 5 and 6, are of such a size that they will not pass between the fins 48. Thus, they lie on top of the latter, and, depending upon the dimensions of the crown 60, on top of that area and are driven around the axis of rotation of the rotor 32 in engagement with the side wall 26 until the outlet 72 is reached, whereupon the runners 76 slide off the fins 48 through outlet 72 and into an awaiting receptacle or the like. Parenthetically, it is noteworthy to bear in mind that the outlet 72 for the runners 76 may advantageously be communicated with suitable transfer and grinder mechanism for pulverizing the runners 76 and recirculating the same back into the molding machine for reuse as constituents of the products to be molded.

It is also important to note that the fins 48 provide driving force for both the smaller components 72 and the larger runners 76 about the side wall 26 to their respective outlets 70 and 72. While this is indeed desirable, the oddly configured runners 76 are typically provided with countless prongs, nibs and other projections that have a tendency to hang up the runners 76 if given the opportunity, thereby preventing their discharge through the outlet 72. Moreover, the progressively diverging nature of the upper extremities 50 of fins 48 in a sense promotes such hanging up because of the tendency for such extremities 50 to become wedged between depending nibs, prongs and the like of the runners 76 as they slide radially downwardly and outwardly along the fins 48. Counteracting that tendency, however, are the cam surfaces 58 of the fins 48 which, because they are obliquely disposed with respect to the conical upper surface defined by the upper extremities 50, tend to cam up or lift the runners 76 out of wedging engagement with the fins 48 as they slide toward the side wall 26. This may be seen, for example, by viewing FIG. 5 in which the runner 76 has a downwardly projecting nib **76*a* and a downwardly projecting prong 76*b* engaged with adjacent fins 48. Remembering that the cam surfaces 58 of the fins 48 are diverging as the outer ends 52 of the fins 48 are approached, it can be seen that the cam surface 58 of the right fin 48*b* in FIG. 5 has the effect of pushing upwardly against the prong 76*b* as the runner 76 slides downwardly along the fins 48, thereby precluding hooking and wedging of the runner 46 on the fin 48**.

In view of the above, by the time the rotor 32 has completed 360° of rotation from the inlet opening 18, the mixture of parts supplied during that 360° of rotation have been fully separated and sorted to leave the mechanism through their respective outlets 70 and 72. Consequently, the incoming supply or mixture of new materials to be sorted may be on a continuous basis without fear that the parts will become clogged and jammed within the mechanism 12 because of over supply thereof.

It should be further noted that the crown 60 is of particular importance in situations where clearance between the overhead molding machine and the mechanism 12 is at a premium. For example, as the runners 76 drop from the molding machine through the inlet opening 18, it is essential that the runners 76 immediately lie down and slide outwardly and downwardly as opposed to standing on end and projecting up through the inlet opening 18. Such undesirable standing up of the runners 76 might result in the mold halves closing on the upstanding runners 76 to the end that the very expensive and delicate mold halves could be damaged beyond repair. By virtue of the imperforate nature of the crown 60, however, the runners 76 are immediately encouraged to lie down flat and slide down the rotor 32 in the intended manner.

Depending upon the nature of the parts being sorted, the fins 48 might not be particularly important insofar as driving the runners 76 around the bowl 24 is concerned; in that event, the crown 60 could extend substantially further outwardly and downwardly than that illustrated herein to provide a much narrower ring-shaped slot 68 than that illustrated, such slot 68 being only sufficient to pass the smaller parts of the mixture down to the lower surface 44. Under such circumstances, the fins 48 might not be utilized at all and the structure **60*c* as illustrated in FIG. 7 caused by the overlapping crown segments 60*a*** and *b* might be sufficient for driving the larger components about the bowl 24.

Additionally, it should be pointed out that the fins 48 may be provided with configurations other that that herein illustrated. For example, rather than being of formed construction with two offset legs 54 and 56, each of the fins 48 may be entirely planar and sloped in virtually the same manner as the cam surface 58 so that there is no perpendicular leg 56 involved. Substantially the same result would obtain as the upper most extremity 50 of such a fin would serve to slidingly engage the parts landing thereon, while the broad flat cam surface 58 thereof would perform its function of preventing hang up of the runners 46 as the latter gravitated down the fins.

I claim:

1. Mechanism for sorting relatively larger parts from relatively smaller parts including:

a rotor having an upright axis of rotation; means defining a radially outwardly extending, downwardly sloping upper surface of said rotor, said upper surface being adapted to receive a mixture of both parts and to feed the same by gravity in a radially outward and downward direction, said rotor being provided with means permitting only the smaller parts to pass from said upper surface during said feeding of the mixture;

means defining a radially outwardly extending, downwardly sloping lower surface disposed below said upper surface in disposition to receive the smaller parts gravitating from the upper surface, said lower surface being adapted to feed the smaller parts by gravity in a radially outward and downward direction;

a wall adjacent the radially outer terminations of said surfaces for preventing escape of the parts from the rotor; and a pair of vertically offset outlets for said parts situated adjacent the radially outer terminations of said surfaces, the outlet for the smaller parts being disposed at a level to gravitationally receive the smaller parts from said lower surface and the outlet for the larger parts being disposed to gravitationally receive the larger parts from said upper surface, said rotor being adapted when rotated about said axis to drive the parts around said wall until said outlets are reached, said upper surface defining means including a series of elongated members positioned around said axis with their upper longitudinal, part-engaging extremities substantially defining elements of a cone having its apex on said axis, said members being laterally spaced apart to present perforations in the upper surface through which the smaller parts may pass to the lower surface.

2. Mechanism as claimed in claim 1, wherein said outlets are circumferentially spaced apart.

3. Mechanism as claimed in claim 1, wherein each of said members is provided with a cam surface sloping laterally downwardly away from its upper longitudinal extremity.

4. Mechanism as claimed in claim 1, wherein said upper surface defining means further includes a conical, imperforate crown having its apex on said axis, said crown having a lower peripheral margin disposed radially inwardly from the radially outer termination of said members so as to expose the same.

5. Mechanism as claimed in claim 1; and a cover over said rotor, said outlets being circumferentially spaced apart and said outlet for the larger parts including a portion thereof aligned with said lower surface, said inlet opening being positioned between said outlet for the larger parts and the outlet for the smaller parts in upstream relationship to said outlets with respect to the direction of rotation of the rotor.

6. Mechanism for sorting relatively larger parts from relatively smaller parts, said mechanism including:

a perforated upper surface adapted to receive a mixture of both parts and permit pass through of only the smaller parts;

a lower surface adapted to receive smaller parts gravitating through the perforations in said upper surface;

means for advancing the larger parts and the smaller parts along respective generally superimposed paths of travel following sorting of the parts by said pass through of the smaller parts; and a pair of vertically offset outlets alongside said paths of travel and in registration with respective ones of said paths of travel, said surfaces being sloped downwardly toward their respective outlets for gravity feed of the sorted parts to their respective outlets during said advancement along said paths of travel, said means for advancing the parts along said paths of travel including a rotor adapted for rotation about an upright axis, said rotor having a series of elongated, laterally spaced apart members positioned with the upper longitudinal extremities thereof disposed substantially as elements of a cone having an apex on said axis, said lower surface being conical, being symmetrical with said axis, and underlying said members, said upper extremities of the members defining said upper surface.

7. Mechanism as claimed in claim 6, wherein said outlets are mutually spaced apart in a circumferential direction.

8. Mechanism for sorting relatively larger parts from relatively smaller parts, said mechanism including;

sorting structure rotatable about an upright axis and sloping radially outwardly and downwardly from said axis;

a wall about the periphery of said structure at the outward and downward termination thereof, said structure including surface means adapted to engage and slidingly support said larger parts for outward and downward gravitation thereof upon introduction of a mixture of both said larger and said smaller parts to said structure, said structure being provided with open space means associated with said surface means and located radially inboard of said wall of a size and configuration adapted for causing gravitational descent of said smaller parts from said surface means and through said open space means before said smaller parts can slide along said surface means to said wall and while precluding such descent by said larger parts;

means for effecting said rotation of the structure to move said larger parts around said axis with said surface means as the larger parts slide downwardly and outwardly along the same toward said wall and said smaller parts descend through said space means to separate from said larger parts;

means for receiving said smaller parts following their said descent through said space means; and an outlet in said wall registered vertically with the path of travel of said larger parts about said axis adjacent said termination of said structure for sliding gravitational discharge of said larger parts from said structure.

9. Mechanism as claimed in claim 8, wherein said receiving means includes a second surface means below said first-mentioned surface means, sloping radially outwardly and downwardly from said axis, and rotatable with said first-mentioned surface means about said axis, said wall having a second outlet therein registered vertically with the outward and downward termination of said second surface means for sliding, downward and outward gravitational discharge of said smaller parts from said second surface means.

10. Mechanism as claimed in claim 9, wherein is provided a series of elongated, laterally spaced apart members positioned with upper longitudinal extremities thereof disposed substantially as elements of a cone having an apex on said axis, said second surface means being conical, being symmetrical with said axis, and underlying said members, said upper extremities of the members defining said first-mentioned surface means and the lateral boundaries of said open space means.

* * * * *